US009222729B2

(12) United States Patent
Bors

(10) Patent No.: US 9,222,729 B2
(45) **Date of Patent: *Dec. 29, 2015**

(54) PLANT AND METHOD FOR HOT FORMING BLANKS

(71) Applicant: Matthias Bors, Allershausen (DE)

(72) Inventor: Matthias Bors, Allershausen (DE)

(73) Assignee: Linde Aktiengesellschaft, Munich (DE)

( * ) Notice: Subject to any disclaimer, the term of this patent is extended or adjusted under 35 U.S.C. 154(b) by 16 days.

This patent is subject to a terminal disclaimer.

(21) Appl. No.: 13/707,787

(22) Filed: Dec. 7, 2012

(65) Prior Publication Data

US 2014/0158256 A1 Jun. 12, 2014

(51) Int. Cl.

| | |
|---|---|
| ***C21D 1/52*** | (2006.01) |
| ***F27B 9/36*** | (2006.01) |
| ***F27B 9/14*** | (2006.01) |
| ***C21D 1/673*** | (2006.01) |

(52) U.S. Cl.
CPC ... *F27B 9/36* (2013.01); *C21D 1/52* (2013.01); *C21D 1/673* (2013.01); *F27B 9/142* (2013.01)

(58) Field of Classification Search
CPC ..... C21D 1/08; C21D 8/00; F23D 14/02
USPC ..... 148/533, 653, 531; 266/258
See application file for complete search history.

(56) References Cited

U.S. PATENT DOCUMENTS

| | | | | |
|---|---|---|---|---|
| 5,345,768 | A * | 9/1994 | Washam et al. | 60/737 |
| 5,364,080 | A | 11/1994 | Kraemer | |
| 5,435,162 | A | 7/1995 | Caudill et al. | |
| 5,458,484 | A * | 10/1995 | Ripka | 431/353 |
| 8,733,144 | B2 * | 5/2014 | Pohl et al. | 72/364 |
| 2007/0160948 | A1 | 7/2007 | Gartz | |
| 2010/0132854 | A1 | 6/2010 | Cola, Jr. | |
| 2012/0090741 | A1 * | 4/2012 | Pellmann et al. | 148/643 |
| 2013/0189634 | A1 | 7/2013 | Bors | |
| 2014/0144198 | A1 * | 5/2014 | Potocki et al. | 72/342.1 |
| 2014/0158256 | A1 * | 6/2014 | Bors | 148/533 |

FOREIGN PATENT DOCUMENTS

| | | | |
|---|---|---|---|
| DE | 103 54 411 | A1 | 6/2005 |
| DE | 10 2009 042 026 | A1 | 3/2011 |
| DE | 102011120681.0 | | 12/2011 |
| EP | 2 090 667 | A1 | 8/2009 |
| FR | 2 847 969 | A1 | 6/2004 |
| WO | WO 2011/126427 | A1 | 10/2011 |

OTHER PUBLICATIONS w/European Search Rpt, Mar. 6, 2013.
European Search Report for EP 12 00 8170, Date of Mailing: Mar. 6, 2013, Authorized Officer: Marc Rischard, 6 pp.
(w/European Search Rpt), Oct. 17, 2012.
European Search Report for EP 12 00 2747 Date of Mailing: Oct. 17, 2012, Authorized Officer: Marc Rischard, 6 pp.

* cited by examiner

*Primary Examiner* — Scott Kastler
(74) *Attorney, Agent, or Firm* — Joshua L. Cohen

(57) ABSTRACT

There is provided a heating device, in particular an austenitization device, for a plant for hot forming blanks, wherein the heating device is for locally heating, in particular austenitization, regions of the blanks and has at least one burner. Also included is means for moving the burner and/or the flame of the burner to the regions of the blank which are to be subjected to local heating.

17 Claims, 3 Drawing Sheets

PLANT AND METHOD FOR HOT FORMING BLANKS

BACKGROUND OF THE INVENTION

The invention relates to a heating device for a plant for hot forming blanks and to a corresponding plant and method for hot forming blanks.

The hot forming of metal sheets is a relatively new development trend in the component manufacturing, in particular for vehicle bodies. In the context of this application, following the well-established language use in the field of shaping technology, metal sheets used hereby are accordingly also identified as "blanks". In principle, a blank is a correspondingly cut, die cut, joined and/or preformed metal sheet.

The hot forming makes it possible to produce components comprising a high stability and a complex geometry without resilience and allows for a significant weight reduction in the case of the auto bodies manufactured therewith, e.g., as well as for an increase of safety, for example of passengers of a corresponding vehicle.

With the increasing demands of stability and stiffness of structure components, in particular in the vehicle, high-strength and highest-strength steels are used increasingly. An increase of the stability provides for a reduction of the vehicle weight, which provides in particular for a reduced pollutant emission and fuel consumption. In the case of current vehicle models, the use of hot formed components can save up to 25 kg of weight.

In essence, hot forming methods are combined forming, hardening and tempering techniques. By using corresponding steels, such as manganese-boron steels, for example, stabilities of more than 1,500 MPa can be reached therewith. Press-hardening methods comprise, for example, the heating of blanks to a temperature, which lies above the complete austenitization temperature, e.g. above 850° C., and the subsequent quick cool-down of the blank in the tool. The desired martensitic structure comprising the desired stability is formed through this. The combination of the forming with the quenching in a tool is occasionally also identified as press- or form-hardening.

In principle, so-called roller hearth furnaces are used for preheating the blanks in response to the hot forming of highest-strength materials for car bodies. The heating of such furnaces typically takes place by means of steel pipes, which are heated electrically or by means of gas burners. To attain process cycle times, which are as short as possible, a certain "supply" of preheated components is necessary in the plant. The heat treatment duration for the temperature control of the steel represents a significant parameter, which defines the clock cycle of a corresponding press. However, due to the low degree of efficiency at temperatures of below 600°, the efficiency of roller hearth furnaces is small. Roller hearth furnaces encompass a length of up to 50 meters and thus require corresponding structural conditions, including an efficient dissipation of excess heat. Drum melting furnaces, which are used as an alternative to roller hearth furnaces, to preheat components, also encompass corresponding disadvantages. They are also heated by means of steel pipes and are unsatisfactory in view of their degree of efficiency.

Press-hardened components are characterized by their high stability and stiffness. As mentioned, metal sheet thicknesses can be reduced through this and weight can thus be saved. However, the low ultimate strain of press-hardened components is problematic, which can lead to the formation of tears in the case of subsequent production operations, such as the welding of further parts, e.g. For this reason, it is desirable to embody certain areas of a vehicle body, e.g. so as to be press-hardened, and to embody other areas such that they encompass a higher ductility and can thus absorb more energy by means of plastic deformation.

Current approaches which are used to generate such locally different characteristics, so-called "tailored properties", include the specific influencing of alloy elements of corresponding semifinished parts, the manufacture of so-called "tailored welded blanks", thus blanks, which are joined from different materials, the partial (local) heating by means of inductive or conductive heating technologies, the partial temperature control of certain areas of the press-hardening tools by locally heating, the partial tempering of the press-hardened components and the masking of certain component areas, so as to suppress the heating (and thus the austenitization) in a corresponding roller hearth furnace. However, such methods are extensive, the result thereof is oftentimes unsatisfactory, and oftentimes cause excessive costs.

There is thus a need for improved possibilities to provide blanks comprising locally different characteristics.

DESCRIPTION OF THE INVENTION

Figure 1:
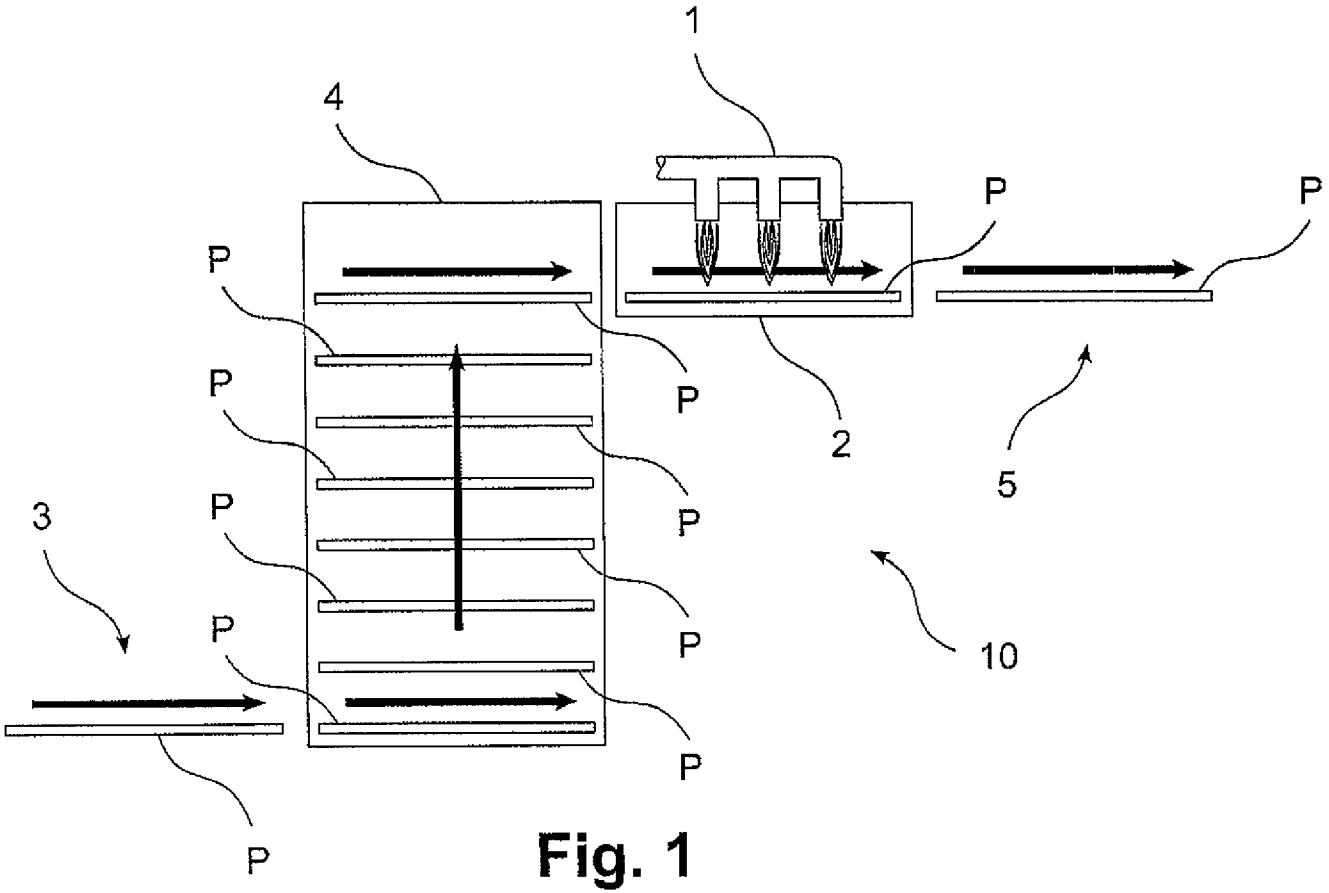
FIG. 1 shows a plant for hot forming blanks according to a preferred embodiment of the invention in a schematic illustration.

In view of the above, the instant invention proposes a heating device, in particular an austenitization device for a plant for hot forming blanks and a corresponding plant, wherein the heating device is embodied for locally heating, in particular austenitization regions, of the blanks and encompasses at least one burner, and which is characterized in that provision is made for means for moving the burner and/or the flame of the burner to the regions, which are provided for the local heating.

A method for hot forming a blank is furthermore proposed, in the case of which at least one region of the blank is heated locally, in particular austenitized, and is formed by means of pressing, which is characterized in that the region of the blanks, which is to be heated, is heated by means of at least one burner, wherein the burner and/or the flame of the burner of the region, which is to be heated, of the blank are moved.

Preferred embodiments are the subject matter of the subclaims as well as of the following description.

The measures proposed according to the invention include the provision of means for moving the burner and/or the flame of the burner to the regions, which are provided for the local heating, in a heating device, in particular austenitization device, for a plant for hot forming blanks, wherein the heating device is embodied for locally heating, in particular austenitization, of regions of the blanks and encompasses at least one burner.

As mentioned above, the term "blanks" in the context of this application shall be understood in a comprehensive manner. The term includes metal sheets, semifinished parts, joined and/or preformed components, which are hot formed, in particular press-hardened, in a corresponding plant.

The measures according to the invention, however, cannot only be used in the case of correspondingly prepared metal sheets, but also in the case of the respective used base materials. The invention thus extends to all workpieces or semi-finished parts, respectively, which can be formed in a corresponding forming process, for example by means of pressing and/or deep-drawing.

A significant aspect of the invention is the use of means for moving the burner and/or the flame of the burner. This makes it possible to specifically heat only certain regions of the blanks continuously, without heating the entire blank. The means for moving the burner or the burner flame allow for an accurate local heating of the blank with a high spatial resolution. Compared to stationary burners, the movable burner has or the movable burners, respectively, have the advantage of increased flexibility. In addition, the burner can be moved very accurately to that location which is to be heated.

According to the invention, it is possible to move one or a plurality of burners having a relatively small flame and/or a narrow focus of the flame across the region, which is to be heated, such that the latter is heated evenly at all locations. Due to a high focusing of the burner flame, the invention, on the other hand, also allows for the heating of small regions. However, in the case of stationary burners, a continuous heating requires the use of a larger flame, which covers the entire area, which is to be heated, but which encompasses the disadvantage that small regions cannot be heated accurately. This is so, because, in the event that a plurality of smaller burners is used, the area between the individual burner flames would be heated less than the areas which are impacted directly by the flames.

The heating device according to the invention, in particular the austenitization device, is embodied for partial heating, in particular austenitizing, thus for heating or austenitizing certain regions or local areas of blanks, respectively. At least one burner flame of the burner can thereby be directed to the region(s) provided for the partial heating, in particular austenitization. A corresponding burner arrangement thus provides in particular for a defined local austenitization of regions, in which a high local stability can be reached subsequently, for example by means of press-hardening. However, a lower hardness and a higher expansion of the material are ensured in the non-austenitized areas after the press-hardening.

The means for moving the burner or the burners preferably include a robot. The term "robot" is to be understood in particular as a machine or as an industrial robot, which can be programmed and/or controlled and which can move the burner to desired positions or tilt or rotate it such that the flame of the burner impacts the region which is to be heated. The movement of the burner either takes place by means of a program sequence, which is provided to the robot, or the robot is equipped with sensors or is connected to sensors, which supply the information required for moving the burner. The robot can be provided with a robotic arm, a gripper or another burner holder and with a control.

The robot and generally the means for moving the burner can be embodied such that the burner can be moved, rotated and/or tilted in all three dimensions. However, it is oftentimes also sufficient to provide for one or two linear guides or linear portals, which allow for a movement of the burner in one dimension (linearly) or in two dimensions (two-dimensionally), as means for a movement of the burner.

In a preferred embodiment of the invention, a hydrogen-oxygen burner, a fuel-oxygen burner, in particular a fuel gas-oxygen burner or an acetylene burner is used. Such burner types are known, for example from DE 103 54 411 A1. The term acetylene burner includes acetylene-oxygen burners and acetylene-air burners.

It is particularly advantageous to use pre-mixing burners. Pre-mixing fuel gas-oxygen burners are also used, for example, for the so-called flame polishing of glass parts, in particular parts made of lead crystal or soda-lime glass. At least a part of the surface of the glass part is hereby heated and melted by means of the burner flame. Corresponding burners are also known as HYDROPDX™ burners and are distributed under this brand name by The Linde Group.

Pre-mixing fuel gas-oxygen burners, in particular hydrogen-oxygen burners, are characterized by a particularly high heat transfer efficiency. Contrary to so-called externally-mixing burners, a gas mixture of fuel gas and oxygen is already supplied to a burner head of a pre-mixing fuel gas-oxygen burner, instead of being generated first in a corresponding burner head. Pre-mixing burners generate particularly hard flames, which are suitable to melt larger surface areas, which can also encompass depressions or other irregularities. As was brought to light according to the invention, this represents a significant advantage as compared to externally-mixing burners. Only a soft flame, which cannot permeate in particular into corners, holes or depressions of a surface, can be generated in externally-mixing burners. The use of a pre-mixing burner thus provides in particular for a local heating of areas, in particular of differently formed areas, of corresponding blanks. Even though it would also be possible to reach high temperatures by heating by means of an externally-mixing burner for a longer period of time, there is a risk thereby that the blank heats up as a whole, not only in the desired areas. The burner used according to the invention can be arranged in the plant or also downstream from the plant between plant and downstream pressing tool.

For locally heating the blanks, it turned out to be advantageous to provide for a burner having a plurality of nozzle openings, from which the fuel-oxygen or the hydrogen-oxygen mixture or the acetylene-air or acetylene-oxygen mixture escapes. In a preferred embodiment, the burner has between 100 and 1000 nozzle openings. A highly continuous heating of the region, which is to be heated, is attained in this manner.

The nozzle openings are distributed to an area of the burner head, which has a width of between 50 and 400 mm. The area of the burner or of the burner head, respectively, which is covered by the nozzle openings, is preferably chosen as a function of the size of the regions, which are to be heated.

Advantageously, the burner has a plurality of nozzle openings, which are arranged close to one another, and have a relatively small diameter. A highly continuous heating of the blanks or of the regions of the blanks, which are to be heated, respectively, can be attained in this manner. Advantageously, the diameter of the nozzle openings is less than 2 mm or less than 1.5 mm. For example, nozzle openings having a diameter of between 0.5 mm and 1.3 mm are chosen. The nozzle openings are preferably arranged tightly, so as to ensure a highly continuous heating. Depending on the size of the nozzle openings, the distance of two adjacent nozzle openings lies between 1 mm and 4 mm.

In a preferred embodiment of the invention, the heating device includes the burner or the burners having an output of between 50 and 500 kW. Typically, the output of one burner is between 30 and 150 kW. Depending on the demands, one or a plurality of burners is installed. The output of the burner or of the burners is distributed to a plurality of nozzle openings, so that the burner output for each nozzle opening remains relatively low, and a local heating of the blank, which is too high, is thus avoided.

According to a particularly preferred embodiment of the invention, the heating device is embodied as austenitization device. By using a pre-mixing hydrogen-oxygen burner or a pre-mixing fuel-oxygen burner, a local austenitization is possible in particular in a particularly efficient manner. A complete austenitization of a blank can also be provided in a particularly quick and energy-efficient manner.

It is to also be pointed out in this context that a partial maceration of areas of a blank is also possible by embodying the heating device with a movable burner. For this purpose, it should be ensured, for example, that the heating device heats the corresponding areas of the blank only to a temperature of below the austenitization temperature.

A preferred heating device, in particular a corresponding austenitization device, is equipped for in particular local heating of the blanks to a temperature of between 750-1,050° C., in particular of between 800-1,000° C., for example of between 850-950° C. A corresponding temperature depends on the respective materials and lies above an austenitization temperature. In the case of the manganese-boron steels, for example, said austenitization temperature is approximately 850° C. In the event that a corresponding blank is preheated to a temperature of just below the austenitization temperature, the austenitization temperature can be reached or exceeded quickly, respectively, by means of a corresponding burner, in particular in areas of the blank, which can be predetermined.

A plant according to the invention for hot forming blanks has a heating device as described above for locally heating the blanks and a pressing device for forming the heated blanks.

Advantageously, such a plant further encompasses at least one loading device for loading the plant with the blanks and/or at least one transfer device for transferring the blanks into at least one pressing device of the plant. By means of corresponding devices, an operation of a corresponding plant is made possible, which can take place with much quicker clock cycles due to the efficient heating by means of the movable burner proposed according to the invention, because the limiting step of a corresponding method, namely the heating of the blanks, is reduced significantly with regard to time.

The clock cycle can in particular be reduced further in that provision is made upstream of the heating device for a preheating device. The blanks initially pass through the preheating device, in which they are heated completely. Certain regions of the blanks are subsequently heated again or are heated further with the help of the heating device according to the invention.

Advantageously, the at least one preheating device includes at least one paternoster furnace. Vertical paternoster furnaces, for example, which encompass an improved energy efficiency and which in particular provide the advantage of being able to replace common roller hearth furnaces, which, as mentioned, are of a large design and which thus require corresponding structural conditions, can be used as paternoster furnaces, which are known in principle. For example, paternoster furnaces can be heated electrically or with fuel and can be operated in corresponding temperature ranges, so that an efficient and reliable heating is ensured.

Advantageously, a corresponding plant encompasses a preheating device, which is equipped to preheat the blanks to a temperature of between 450-850° C., in particular between 600-800° C., for example between 650-750° C. In another embodiment, the preheating device serves to preheat the blanks to a temperature of between 450° C. and 550° C. Advantageously, corresponding preheating temperatures lie just below or at a certain distance below a lower limit of an austenitization temperature of corresponding materials, so that a complete austenitization of the materials is not yet attained by means of the preheating of the blanks. The respective temperature, which is to be used, depends on the respective material of the blanks. As mentioned, the complete austenitization temperature of manganese-boron steels is 850° C., for example. The person of skill in the art can derive corresponding temperatures simply from available material key figures. Due to the only relatively small distance to the austenitization temperature, a corresponding preheating provides for a subsequent partial austenitization within a short period of time in an energy-efficient manner, in particular in (defined) areas of blanks, which can be predetermined. As mentioned, a partial maceration of a corresponding blank material can also be provided in response to the heating to temperature of below the austenitization temperature.

It turned out to be advantageous to embody this preheating device with at least one premixing hydrogen-oxygen burner or fuel gas-oxygen burner. A highly efficient, in particular also an area by area preheating of blanks is possible with this.

Advantageously, the heating device, in particular an austenitization device, and the preheating device are combined in the form of a structural unit. This provides for compact plants, which have a small design and which can be operated in an energy-efficient manner, which, for example, require only a heat or temperature insulation, respectively.

It turned out to be advantageous to provide the heating device with a housing. The heat losses during the local heating of the blank are reduced in this manner and the degree of efficiency is improved accordingly.

The invention is used for the manufacture of auto body components of motor vehicles, for example the B-pillar of a motor vehicle cell, in a particularly advantageous manner. Particular demands are made to such auto body components in view of hardness, material stability and expansion characteristics. In particular, the blanks used for this purpose are not to be too brittle, because tears can otherwise form in the material in response to the forming processes and welding processes, which are necessary for the manufacture of the auto body components.

The burner or the burners used for the heating, in particular austenitization, according to the invention produce water or water vapor-containing exhaust gases. When these water-containing exhaust gases reach the preheating device, a considerable dew point occurs in the preheating device, which can lead to an increased portion of diffusible hydrogen in the metallic structure of the blanks. The blanks thus become more brittle and the above-described material tears ("delayed fracture") can occur.

Provision is thus preferably made for means, which prevent exhaust gas from reaching from the burner or from the burners of the heating device into the preheating device. In a preferred embodiment, provision is made for this purpose for a suction device for extracting exhaust gas from the housing. For this purpose, the housing encompasses one or a plurality of vents, which are connected to an extraction device. The exhaust gas does not only flow out of the vents, but is removed actively. The vents are not identical with the inlet or outlet opening for feeding or discharging the blank into and out of the housing.

Preferably, the vents are arranged such that a flow, which keeps the exhaust gas away from the inlet opening, is embodied in the housing, so as to prevent that exhaust gas reaches via the inlet opening into the preheating device connected upstream thereof. In addition, the inlet opening can be provided with a gas veil, in particular a nitrogen veil. A gas, for example nitrogen, is blown into the housing in the area of the inlet opening, so as to form a gas barrier for escaping exhaust gas. Instead of or in addition to the gas veil, it is also possible to close the inlet opening with a slide, a flap or another mechanical means, so as to prevent the escape of exhaust gas.

Provided that further treatment steps follow downstream from the housing, which are sensible with reference to moisture or other components or characteristics of the exhaust gas, it can be sensible to also provide for corresponding protective measures for preventing the escape of exhaust gas for the outlet opening of the housing.

The method according to the invention for hot forming of a blank is characterized in that a region of the blank is heated by means of at least one burner, wherein the burner and/or the flame of the burner is moved towards the region of the blank, which is to be heated, and the blank is subsequently formed by means of pressing.

In an embodiment, the blanks are loaded into a plant according to the invention, are preheated to a preheating temperature in a preheating device of the plant, are at least locally heated or austenitized, respectively, in the heating device, in particular in an austenitization device, and are formed by means of pressing in a pressing device. As explained, the pressing method can be a press-hardening method.

The plant according to the invention for hot forming blanks, the heating device according to the invention for the partial austenitizing of the blanks for such a plant as well as the method according to the invention for hot forming and partial austenitizing benefit similarly from the above-explained advantages.

The afore-mentioned features and the features which will be explained below cannot only be used in the respective specified combination, but also in other combinations or alone, without leaving the scope of the instant invention.

The invention is illustrated schematically in the drawings by means of an exemplary embodiment and will be described in detail below with reference to the drawings.

In the Figures, the same elements or elements having the same effect have identical reference numerals, if applicable, and will not be explained again for the sake of clarity.

FIG. 1 shows a plant for hot forming blanks according to a preferred embodiment of the invention. The plant as a whole is identified generally as 10. It has a loading device 3, in which corresponding blanks P, for example punched metal sheet pieces, can be loaded into a corresponding plant in arrow direction (lower horizontal arrow). Provision is made for a preheating device 4, which is illustrated herein schematically as a paternoster furnace. The blanks P are introduced into a lower area of the preheating device 4 in arrow direction, are lifted upwards (illustrated by means of a vertical arrow) and are heated continuously during the lifting. Reference is made to the above information with regard to the temperatures used in the preheating device 4.

In an upper area of the preheating device 4, the blanks P leave the latter again in the arrow direction (upper horizontal arrow). They subsequently pass through an austenitization device 2, which encompasses a burner 1, which is symbolized herein as a three-flamed burner. The burner 1 can encompass any number of burner flames. The burner 1 can also be embodied so as to be mobile and can impact different areas of a blank P consecutively. For this purpose, provision can be made for corresponding movement devices, which can also be controlled fully-automatically, for example, by using a corresponding control. The blanks P pass through the austenitization device 2 in arrow direction and are heated there at least in predetermined locally defined areas to a temperature, which lies above an austenitization temperature of the corresponding material.

The blanks P subsequently reach into a transfer device 5 and are transferred there to a pressing tool, for example, which however is not illustrated in FIG. 1.

Figure 2:
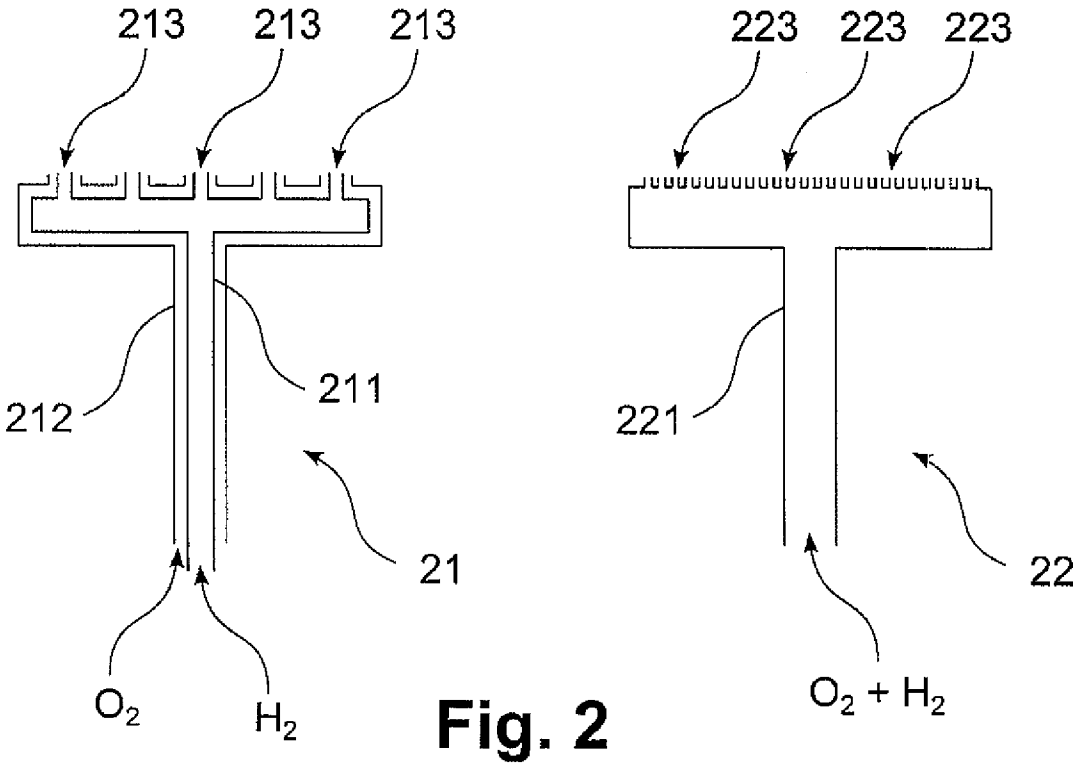
FIG. 2 shows burner heads for being used according to the state of the art, and according to an embodiment of the invention, respectively, in a schematic illustration.

A preferred embodiment of a burner head, which can be used according to the invention, is illustrated at 22 in FIG. 2 (right). A burner head for use according to the state of the art is shown at 21 in FIG. 2 (left).

A so-called externally-mixing burner head for being used according to the state of the art is identified with 21. A pre-mixing burner head, which can be used according to the invention, is identified with 22.

For example, the externally-mixing burner head 21 has a line 212 which is located on the outside for providing oxygen, and a line 211 which is located on the inside for providing fuel gas, in particular hydrogen. A mixing of the gases provided via both channels first takes place in the area of burner nozzles 213. As was established, corresponding so-called externally-mixing burners generate relatively soft flames, which are only conditionally suitable for the purposes according to the invention. The minimal distance between two burner nozzles 213 is furthermore defined by the dimensions of the fuel gas supply line 211 and the oxygen supply line 212. This means that the distance of the fuel nozzles 213 among one another cannot fall below a certain minimum distance, whereby the number of the fuel nozzles 213 for each length is limited upwards vice versa.

A much harder burner flame which ensures an improved energy transfer can be generated with a pre-mixing hydrogen-oxygen burner, which is used according to the invention and which has a common channel 221, via which a hydrogen-oxygen mixture is supplied to the burner head 22. Areas in particular which are embodied with recesses or more complex contours, e.g., can be impacted with the necessary heat in a more reliable manner. The corresponding gas mixture already flows out of the nozzles 223 as mixture and is ignited there. In addition, the burner nozzles 223 can be arranged much more tightly than in the case of an embodiment as an externally-mixing burner. The tight arrangement of the burner nozzles 223 provides for considerably more even heating of the blank.

Figure 3:
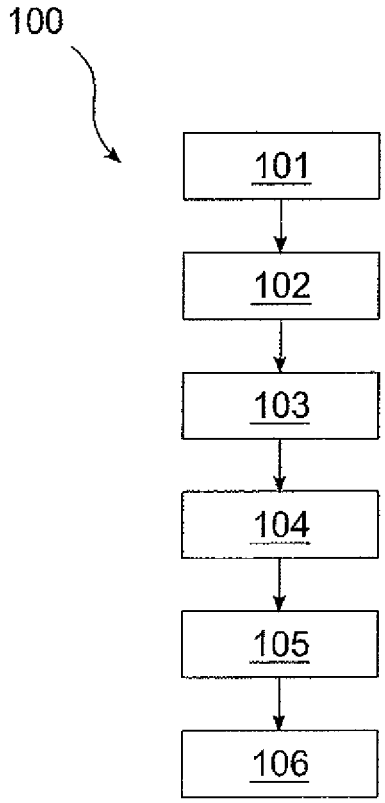
FIG. 3 shows a method for hot forming blanks according to an embodiment of the invention in the form of a flow chart.

FIG. 3 shows a flow chart of a method according to a particularly preferred embodiment of the invention in a schematic illustration. In a first method step 101, corresponding blanks P are punched out of a metal sheet. In a method step 102, they are loaded into a hot forming plant according to the invention, for example by means of a loading device. This can take place continuously. In a step 103, the blanks P are preheated in the plant for the purpose of which the afore-explained means can be used. In a step 104, partial austenitization takes place as explained above. After the austenitization, the blanks P are transferred into a pressing tool by means of a transfer device in step 105 and are pressed there in a step 106, for example press-hardened. After quenching in the pressing tool, blanks comprising areas with different joining characteristics are thus available.

What is claimed is:

1. A heating device for a plant for hot forming blanks, comprising:

at least one pre-mixing burner, the at least one pre-mixing burner comprising a plurality of nozzle openings, wherein each one of the plurality of nozzle openings comprises a diameter less than 2 mm, and a distance between two adjacent nozzle openings is from between 1 mm and 4 mm; and means for moving at least one of the at least one pre-mixing burner and a flame of the at least one pre-mixing burner to regions of the blanks for local heating.

2. The heating device according to claim 1, wherein the heating device comprises an austenitization device.

3. The heating device according to claim 1, wherein the moving means comprises a robot.

4. The heating device according to claim 1, wherein the at least one pre-mixing burner is selected from the group consisting of a hydrogen-oxygen burner, a fuel-oxygen burner and an acetylene burner.

5. The heating device according to claim 2, wherein the austenitization device is adapted for the local heating of the blanks to a temperature of between 750 to 1050° C.

6. The heating device according to claim 1, wherein the plurality of nozzle openings comprise from between 100 to 1000 nozzle openings.

7. The heating device according to claim 1, wherein the heating device comprises an output of between 50 and 500 kW.

8. The heating device according to claim 1, further comprising a housing for the heating device.

9. The heating device according to claim 8, wherein the housing further comprises a suction device for extracting exhaust gas from the housing.

10. A plant for hot forming blanks, comprising:

a heating device having at least one pre-mixing burner, the at least one pre-mixing burner comprising a plurality of nozzle openings, wherein each one of the plurality of nozzle openings comprises a diameter less than 2 mm, and a distance between two adjacent nozzle openings is from between 1 mm and 4 mm;

means for moving the at least one pre-mixing burner for locally heating the blanks; and a pressing device for forming the heated blanks.

11. The plant according to claim 10, further comprising at least one loading device for loading the plant with the blanks, and at least one transfer device for transferring the blanks into the pressing device.

12. The plant according to claim 10, further comprising at least one preheating device arranged upstream of the heating device.

13. The plant according to claim 12, wherein the at least one preheating device comprises at least one paternoster furnace.

14. The plant according to claim 12, wherein the at least one preheating device is adapted to preheat the blanks to a temperature of between 450 and 850° C.

15. The plant according to claim 12, wherein the at least one preheating device comprises at least one of a pre-mixing hydrogen-oxygen burner, and one pre-mixing fuel-oxygen burner.

16. A method for hot forming a blank, comprising:

moving at least one pre-mixing burner to a region of the blank to be heated, the at least one pre-mixing burner comprising a plurality of nozzle opening, wherein each one of the plurality of nozzle openings comprises a diameter less than 2 mm, and a distance between two adjacent nozzle openings is from between 1 mm and 4 mm;

supplying a gas mixture of fuel gas and oxygen to the at least one pre-mixing burner for generating a flame from said pre-mixing burner;

heating the region with the flame of the at least one pre-mixing burner for particular austenitization of said region; and pressing the blank.

17. The method according to claim 16, further comprising coating the blank with a material selected from the group consisting of aluminum silicon, and zinc.

* * * * *